United States Patent [19]

Beier

[11] Patent Number: 5,022,542

[45] Date of Patent: Jun. 11, 1991

[54] CRANE LEG CONNECTION

[75] Inventor: Dale A. Beier, New Berlin, Wis.

[73] Assignee: Harnischfeger Corporation, Brookfield, Wis.

[21] Appl. No.: 281,723

[22] Filed: Dec. 9, 1988

[51] Int. Cl.[5] ..... B66C 5/02

[52] U.S. Cl. ..... 212/219; 104/126; 212/218

[58] Field of Search ..... 212/218, 219, 220; 104/126

[56] References Cited

FOREIGN PATENT DOCUMENTS

| | | | |
|---|---|---|---|
| 166122 | 1/1965 | U.S.S.R. | 212/218 |
| 222620 | 5/1967 | U.S.S.R. | 212/218 |
| 303282 | 11/1969 | U.S.S.R. | 212/218 |
| 887436 | 4/1980 | U.S.S.R. | 212/219 |
| 1245541 | 7/1986 | U.S.S.R. | 212/218 |

*Primary Examiner*—Sherman D. Basinger
*Assistant Examiner*—Thomas J. Brahan
*Attorney, Agent, or Firm*—Richard C. Ruppin

[57] ABSTRACT

A crane leg connection is disclosed in which a crane has a frame length greater than its width, and has supporting legs including facing leg members connected to the frame and extending from the frame downward and away from each other and away from the frame in a direction transverse to the length of the frame. A support beam is mounted on the frame, and at least one of the leg members is connected to the support beam. A support arm connects the support beam and the frame together and carries the vertical load on the frame and transfers that load through the support beam to the leg. The support arm is connected to the support beam and frame such that the leg and frame are movable relative the each other transversely to the length of the frame. Another arm is affixed to at least one of the leg members and extends toward the frame, and an arm affixed to the frame extends toward the arm affixed to the leg member. A link means connects the arms affixed to the leg member and frame together in a movable manner such that the frame and leg member are movable relative to each other.

8 Claims, 2 Drawing Sheets

CRANE LEG CONNECTION

FIELD OF THE INVENTION

This invention relates to a connection arrangement between the frame and legs of a crane. More particularly, the invention relates to a connection between the legs and frame of a gantry crane which permits movement of the legs and frame relative to each other while at the same time maintaining the load carrying stability of the frame and legs.

BACKGROUND OF THE INVENTION

Gantry cranes having long overhead frame spans are subject to considerable movement along the frame length due to picking up and releasing a load, and moving the load along the frame. This movement causes stressing of frame members which is very high at joints of links and bracing in truss type gantry crane frames. This is especially true of portal type gantry cranes in which the frame is cantilevered in the direction of the length of the frame beyond the legs. At the joining areas of the frame and gantry legs, the links or arms connecting the frame to the legs which transfer the load on the frame to the legs are particularly highly stressed with the greatest stress being the immediate joinder area of an arm or link to the leg or a frame member. Where these links are rigidly joined, such as by welding, the stresses at the joints cause cracking and failure of the connections. Moreover, rigid joining of the connecting links creates moment forces which add stress to the joints and increases the rate of failure.

SUMMARY OF THE INVENTION

It is a general object of this invention to provide a movable connection between the frame and the legs of a gantry crane while at the same time maintaining the load carrying stability of the frame and legs. It is a further object of the invention to provide a combination of connections between the frame of a gantry crane and a leg each of which accommodate movement and carrying of load in a different direction and which together permit frame and leg relative movement necessary to minimize stress failure of the connections between the frame and leg.

The invention is accomplished by providing a crane having a frame length greater than its width and supporting legs including facing leg members connected to the frame and extending from the frame downward and away from each other and away from the frame in a direction transverse to the length of the frame. A support beam is mounted on the frame, and at least one of the leg members is connected to the support beam. A first arm is affixed to at least one of the leg members and extends toward the frame. A second arm is affixed to the frame and extends toward the first arm. A link means connects the first and second arms together in a movable manner such that the frame and leg member are movable relative to each other.

A third arm may be provided to connect the support beam and the frame together and to carry the vertical load on the frame and transfer that load through the support beam to the leg member. The third arm is movably connected to the support beam and to the frame such that the leg member and the frame are moveable relative to each other in directions transverse to the length of the frame.

The first arm extending from the first leg and the second arm extending from the frame may be spaced apart and be connected by a movable link bridging the space between the arms and pivotally connected to each of them.

The frame of the crane may be of a truss type having a plurality of chords each of which is spaced from the other. A plurality of angular braces connect at least two of the chords together. The support beam may be mounted on one of the chords of the frame and at least one of the leg members is connected to the end of the support beam and extends downwardly and outwardly from the frame and from another facing leg. Reinforcing means is affixed to at least one of the angular braces connecting the chords. A leg anchor arm is connected to the frame through the reinforcing means and a leg anchor arm extends from the leg towards the frame anchor arm. A link is pivotally connected to each of the anchor arms such that the frame and first leg are movable relative to each other.

BRIEF DESCRIPTION OF THE DRAWINGS

Further objects and advantages of the invention will appear when taken in conjunction with the accompanying drawings, in which.

DETAILED DESCRIPTION OF THE INVENTION

Figure 1:
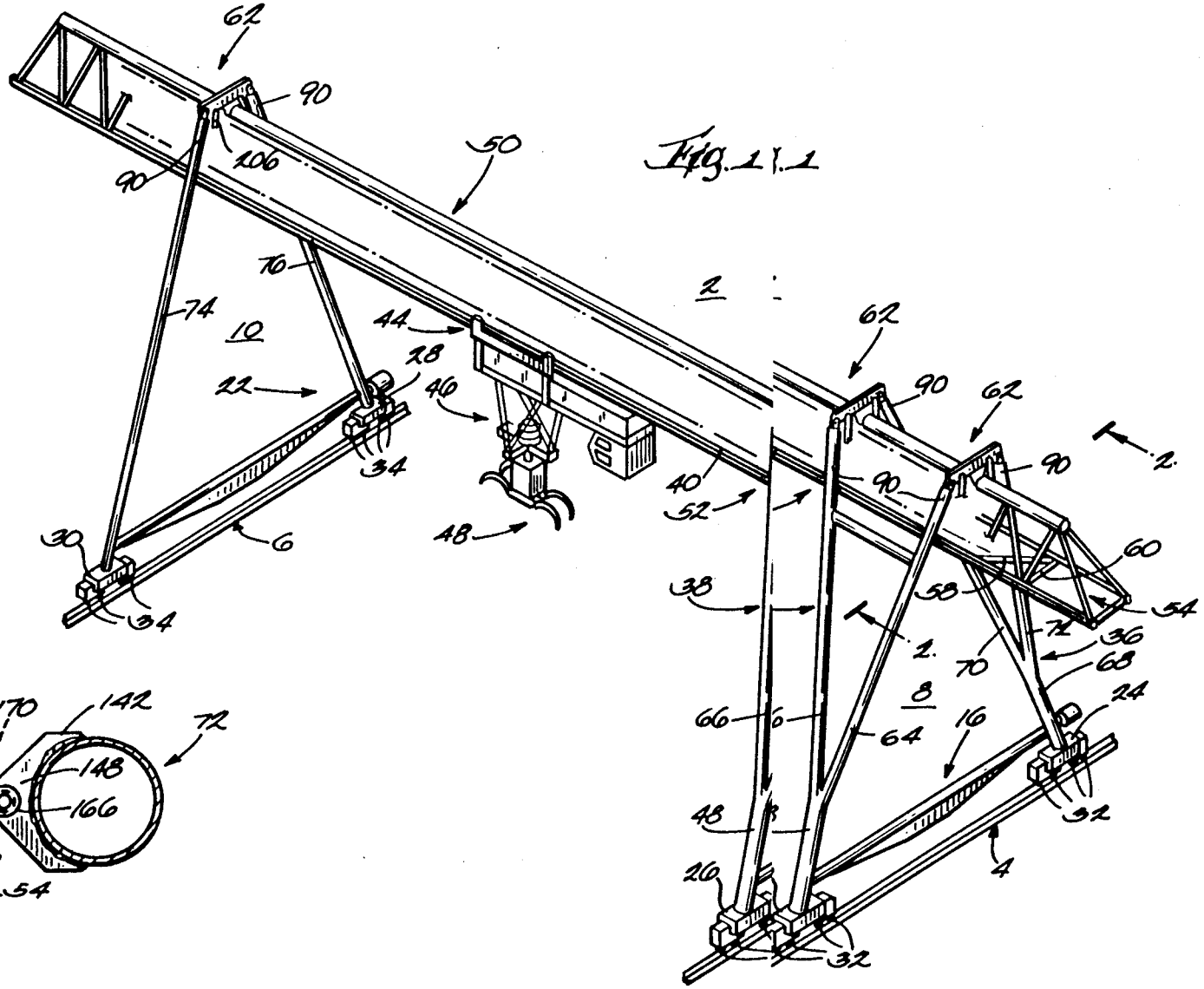
FIG. 1 is a perspective view of a portal type gantry crane having a truss frame and incorporating the leg connection according to the invention.
Figure 3:
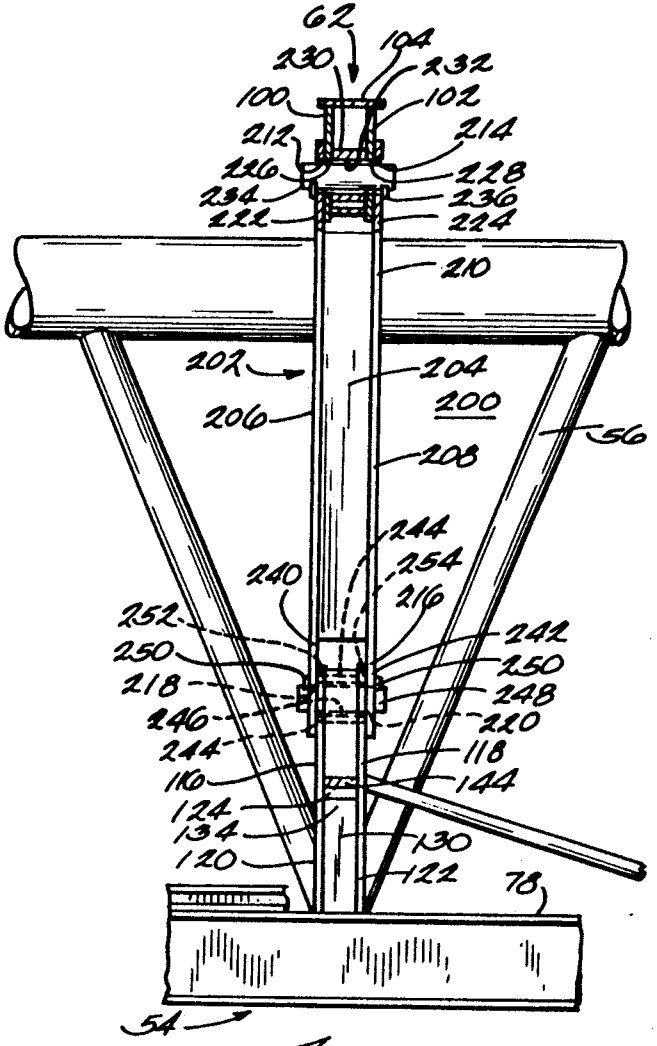
FIG. 3 is a side elevation view, in cross section, taken along the lines 3—3 of FIG. 2.
Figure 2:
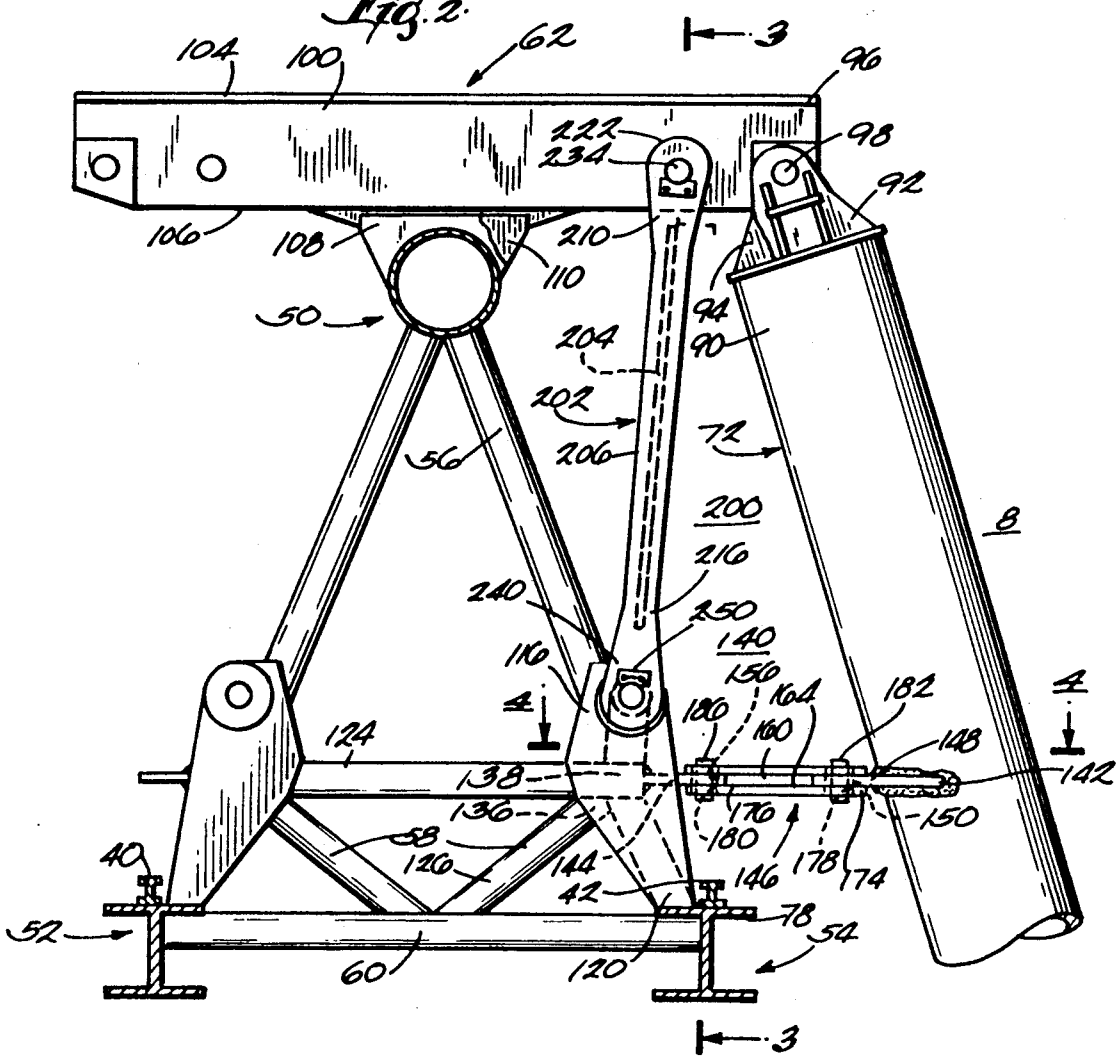
FIG. 2 is an end elevation view, in cross section, taken along the lines 2—2 of FIG. 1.

Referring generally to FIGS. 1-3 of the drawing, a portal crane is illustrated as having a frame 2 disposed generally horizontally and overlying two generally parallel rails 4 and 6 and two spaced apart legs 8 and 10 affixed to the frame 2 and respectively extending between the frame and the rails 4 and 6. The rails 4 and 6 are laid in a material storage area such as a log yard in which logs are stored prior to their use for paper or other wood products. The legs 8 and 10 respectively have lower base ends 16 and 22 and the base ends 16 and 22 respectively have a pair of spaced apart wheel assemblies 24, 26 and 28, 30. The wheel assemblies 24 and 26 include wheels 32 and engage and ride on the rail 4, and the wheel assemblies 28, 30 include wheels 34 and engage and ride on the rail 8, thus permitting the portal crane to travel along the rails 4 and 6 through the material storage area.

A pair of parallel tracks 40 and 42 are affixed to the frame 2 and support a trolley 44 for travel along the length of the frame 2. A hoist 46 is mounted on the trolley 44 and includes a grapple hook 48 for raising and lowering a load of material, such as the logs which are to be stored in or removed from the storage area, and holding the material as the trolley 44 moves along the tracks 40 and 42, and the crane moves along the rails 4 and 6.

The frame 2 is generally of a truss construction having a top chord 50 and two bottom chords 52 and 54 comprising wide flange I-beams, all extending substantially the length of the frame 2. Upper diagonal laces 56 are connected between the top chord 50 and the bottom chords 52 and 54. Bottom diagonal laces 58 and perpendicular laces 60 connect the bottom chords 52 and 54. As may be seen in FIG. 2, the chords and laces are positioned such that the frame 2 has a triangular cross-section.

The leg 8 is positioned toward one end of the length of the frame 2 and includes a leg section 38 having a lower tubular elongated member 48 affixed to a pair of upper tubular elongated member 64 and 66, and a leg section 36 having a lower tubular elongated member 68 affixed to a second pair of upper tubular elongated members 70 and 72. The lower tubular members 48 and 68 have lower ends affixed to the lower base 16 of the leg. The leg 10 is positioned toward the other end of the length of the frame tube and includes tubular members 74 and 76 having lower ends affixed to the lower base 22. In providing stable support for the frame 2, the pair of tubular members 70 72 and the pair of tubular members 64 66 extend downward and away from each other, and away from the frame 2. Similarly, the tubular members 74 and 76 of leg 10 extend downward and away from each other and away from the frame 2. Leg support beams 62 are mounted on the frame 2 at the locations of each of the legs 8 and 10. Each of the leg 8 upper tubular members 70, 72 and 64, 66, and each of the leg 10 tubular members 74 and 76 have ends 90 connected to a support beam 62.

Figure 4:
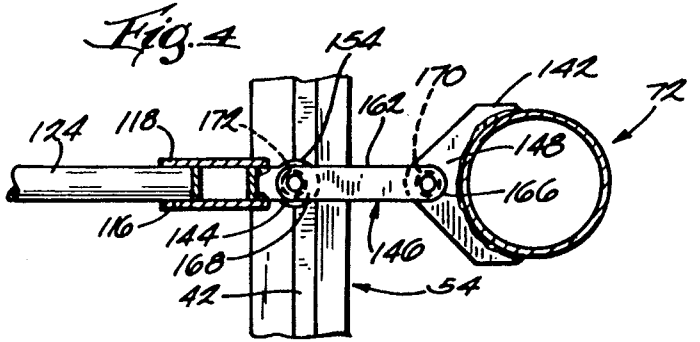
FIG. 4 is a plan view, in cross section, taken along the lines 4—4 of FIG. 2.

Referring now to FIGS. 2-4, the connections of the leg 8 at tubular members 70, 72 and 64, 66 of sections 36 and 38 and tubular members 74 and 76 of leg 10 at their upper ends 90 to the frame 2 are identical or a mirror image of each other and consequently only the connection of tubular member 72 of leg 8 will be described. The upper end 90 of tubular member 72 of leg 8 includes a pair of spaced apart plates 92 and 94 connected to an end 96 of the support beam 62 by means of a pin 98 extending through the support beam end and through the end 90 of the leg member 72. The support beam 62 has a substantially box-shaped cross section and includes side plates 100, 102, a top plate 104 and a bottom plate 106. A pair of downward extending parallel spaced-apart plates 108, 110 are affixed to the beam 62 and follow the upper portion of the circumferencial surface of the top chord 50. However, the plates 108, 110 are not affixed to the top chord 50. The fitting of the plates 108 and 110 around a portion of the top chord 50 assists in preventing movement of the frame 2 transversely of its length and transfers the force of attempted movement transversely through the support beam 62 to the tubular leg members 72 and 64.

A pair of parallel, spaced-apart attachment plates 116 and 118 are rigidly affixed to the frame 2 such as by means of welding to at least one of the diagonal laces 56 and preferably to two adjacent laces at a position between the two laces. Also, the reinforcing plates 116 and 118 have lower ends 120 and 122 welded to an upper flange 78 of bottom chord 54. The reinforcing plates 116 and 118 are also affixed to a horizontal leg brace 124 and a diagonal leg brace 126 extending downwardly and connecting to a perpendicular lace 60 connecting the two bottom chords 52 and 54. The horizontal leg brace 124 and the diagonal leg brace 126 are both affixed to a diagonal stub leg brace 130 positioned between the reinforcing plates 116 and 118. The stub leg brace 130 is affixed at a lower end to the flange 78 of the chord 54, and the horizontal brace 124 and diagonal leg brace 126 are affixed to the upper end 134 of the stub leg brace 130 at their respective ends 138 and 136. The affixation of the stub leg brace to the bottom chord 54, to the horizontal leg brace 124 and diagonal leg brace 126, and to the reinforcing plates 116 and 118 are preferably by means of a weld attachment.

A lower leg connection 140 extends between the leg member 72 and the reinforcing plates 116 and 118 and connects the leg member 72 to the frame 2. The lower leg connection 140 includes an anchor arm 142 affixed preferably by means of welding to the leg member 72 and extending toward the frame 2, an anchor arm 144 affixed preferably by means of welding to the reinforcing plates 116 and 118 and the horizontal leg brace 124, and extending toward the leg member 72, and a double link 146 connected to the anchor arms 142 and 144. The anchor arm 142 has an end 148 including an opening 150 and the anchor arm 144 has an end 154 including an opening 156. The double link 146 includes flanges 162 and 164 and a web 160 connected between the flanges. The flange 162 has opposite ends 166 and 168 respectively having openings 170 and 172 and the flange 164 has opposite ends 174 and 176 respectively having openings 178 and 180. The openings 170 and 178 in the link 146 and the opening 150 in the arm 142 are axially aligned and the openings 168 and 180 in the link 146 and the opening 156 in the anchor arm 144 are axially aligned. A pin 182 extends through the openings 150, 170 and 178 and a pin 186 extends through the openings 156, 168 and 180. The leg member 72 is thus movably connected to the frame 2 in a pivotable manner through the pinned connection of the arm 142 and the arm 144. This movable connection of the leg member 72 and the frame 2 permits movement of the frame 2 and leg member 72 and thereby the leg 8 in directions parallel to the length of the frame 2 as well as in directions transverse to the length of frame 2. The double articulation of the pivotal connection of the link 146 between the arms 142 and 144 provides movement of the arms 142 and 144 relative to the link 146 and facilitates the movement in parallel directions of the leg member and frame relative to each other. This movable connection of the leg member 72 and the frame 2 is of particular importance as the frame and the leg move as result of lifting and movement of the load by the hoist 46, particularly in the direction of the length of the frame 2, and by movement of the leg member 8 along the rail 6. Because of the movability of the connection between the leg 8 and the frame 2, flexibility is provided that does not stress the connecting members of the frame or leg such that cracking and breaking of the connection takes place. Thereby, problems of shutdown of the crane operation and expenses of maintenance, typically repairing the connection by welding, are eliminated.

With reference to FIGS. 2 and 3, an upper leg connection 200 is provided and includes a substantially vertical connecting arm 202 between the support beam 62 and the frame 2. The connecting arm 202 has a pair of flanges 206 and 208 and a web 204 connected between the flanges. The connecting arm 202 includes an upper end 210 including a flange end 222 of flange 206 and a flange end 224 of flange 208 respectively having axially aligned openings 212 and 214. The arm 202 further includes a lower end 216 including a flange end 240 of flange 206 and a flange end 242 of flange 208 respectively having axially aligned openings 218 and 220. The flange ends 222 and 224 respectively are positioned outside of and adjacent to the side plate 100 and the side plate 102 of the support beam 62. The side plates 100 and 102 of the support beam 62 respectively have openings 226 and 228 axially aligned with each other and with the openings 212 and 214 in the flange ends of the connecting arm. A sleeve 230 having an opening 232 in alignment with the openings 212 and 214 is positioned between and in engagement with the plates 100 and 102 of the beam 62. A pin 234 extends through the aligned openings 212, 214, 226, 228 and 232 with its axis positioned substantially parallel to the length of the frame 2. Keeper plates 236 mounted on the flange ends 222 and 224 retain the pin 234 in position. The lower ends 240 and 242 of the flanges 206 and 208 of the connecting support arm 202 are respectively positioned outside of and adjacent to the reinforcing plates 116 and 118. The reinforcing plates 116 and 118 also respectively include openings 252 and 254 and a sleeve 244 positioned between and having a through opening 246 in axial alignment with openings 218 and 220 and with openings 252 and 254 in the plates 116 and 118. A pin 248 extends through the axially aligned openings 218, 220, 252, 254 and 246 and is retained in position by keeper plates 250 mounted on the lower flange ends 240 and 242. The pin 248, like the pin 234 connecting the upper end 216 of the connecting support arm, is positioned with its axis substantially parallel to the direction of the length of the frame 2.

It should be noted that although the arm 202 has been described as being vertical or substantially vertical, it may be slightly offset from the vertical with the upper end 210 positioned slightly outwardly from the frame 2 relative to the position of the lower end 216. This slight angular position of the arm 202 results in increased transverse rigidity of the combination of leg members 72 and 64, and beam 62, to better withstand forces transverse to the frame 2 due to movement of the hoist and its load in a transverse direction and movement of the crane along the rails 4 and 6. Substantially all of the vertical load on the frame 2 is transferred through the upper leg connections 200 to the legs 8 and 10 through the connecting support arms 202. Because of the vertical movement of the frame 2 caused by the load carried by the hoist 46 and the transverse force on the support arms 202 due to swinging of the load on the hoist 46 and movement of the crane on the rails 4 and 6, a very substantial amount of tension, compression and twisting stress at the connection of the arm 202 to the support beams 62 and frame 2 takes place. The pivotal connection of the arms 202 to the frame through the reinforcing plates 116 and 118 and the support beam 62 permits movement of the arm relative to the frame so that these members can move when such stress is imposed on them to thereby eliminate cracking and breaking of rigid connections such as those which occur at a welded joint. Providing a preselected clearance between the pin 234 and sleeve 230 in the beam 62 and between the pin 248 and the sleeve 244 between the reinforcing plates 116 and 118, also permits some movement in a direction parallel to the length of the frame 2 to provide flexibility eliminating cracking of a rigid joint due to this type of movement. Moreover, when excessive wear of the pins and sleeves connecting the arms 202 to the frame 2 and beams 62 does occur, their replacement is less costly and much easier to accomplish.

The use of the lower leg connection 140 and upper leg connection 200 together in combination for transferring the load on the frame 2 to the legs 8 and 10 is highly desirable in that each connection provides flexibility and movement of the frame to alleviate stress which either one of the connections alone would not provide. If only one of the lower or upper leg connections were used, the movement permitted by either one would cause the other connection, if it were of a fixed or rigid type, to be more highly stressed and fail more rapidly then it would otherwise if both connections were of a rigid type. Thus, the two connections cooperate to provide a flexibility between the frame and legs of the crane which alleviates the stress at the points of attachment of the connections and at the same time carry the various types of loads to which the crane is subjected without excessive undesired movement of the frame 2.

It will be understood that the foregoing description of the present invention is for purposes of illustration only, and that the invention is susceptible to a number of modifications or changes, none of which entail any departure from the spirit and scope of the present invention, as defined in the hereto appended claims.

What is claimed is:

1. In a crane including a truss frame having a plurality of spaced-apart chords extending in the direction of the length of the frame, a plurality of angular laces connecting at least two of the chords, and at least one leg having first and second facing leg members supporting the frame and extending from the frame downward and away from each other and away from the frame in a direction transverse to the length of the frame, the combination comprising: a support beam mounted on and connected to the frame and having an end extending transversely of the length of the frame, at least the first leg member having an upper end pivotally connected to the end of the support beam about an axis in the direction of the length of the frame;

reinforcing means affixed to at least one of said plurality of angular laces for providing a location for connecting the first leg member to the frame;

a frame anchor arm rigidly affixed to said reinforcing means and having an end extending toward said first leg member;

a leg anchor arm rigidly affixed to said first leg member and having an end extending toward the frame anchor arm; and link means between and pivotally connected to the frame and leg anchor arm for permitting movement of the first leg member in directions transverse of and in the direction of the length of the frame.

2. The combination according to claim 1 further comprising a connecting arm connected pivotally about an axis in the direction of the length of the frame to the frame and to the support beam for supporting the load carried by the frame on the support beam and thereby on the first leg member.

3. The combination according to claim 2 wherein the connection arm is pivotally connected to the reinforcing means.

4. In a crane including a frame having an elongated length, and at least one pair of legs having first and second facing leg members on opposite sides of and supporting the frame and extending from the frame downward and away from each other and away from the frame in a direction transverse to the length of the frame, the combination comprising:

a support beam mounted on the top of the frame, at least the first leg member being connected to the support beam;

a first arm affixed to the first leg member and extending toward the frame, the first arm including a first end having a first opening;

a second arm affixed to the frame and extending from the frame toward the first arm, the second arm including a second end spaced apart from the first end of the first arm and having a second opening; and link means movably connecting the first and second arms together with the crane in a normal operating condition for movement of the frame and first leg member relative to each other in directions parallel to the length of the frame the link means including a movable link bridging the space between the first and second arms and including a first end having a first opening in axial alignment with the first opening of the first arm and a second end having a second opening in axial alignment with the second opening of the second arm, and first and second pins respectively extending through the aligned first openings in the link and first arm and through the aligned second openings in the link and second arm whereby the frame and first leg are pivotally connected and movable relative to each other.

5. The combination according to claim 4 further comprising a third arm extending downward from the support beam to the frame, the third arm being movably connected to the beam and to the frame for movement in directions transverse to the length of the frame.

6. In a crane including a frame having an elongated length, and at least one pair of legs having first and second facing leg members on opposite sides of and supporting the frame and extending from the frame downward and away from each other and away from the frame in a direction transverse to the length o the frame, the combination comprising:

a support beam mounted on the top of the frame, at least the first leg member being connected to the support beam;

a first arm affixed to the first leg member, the first arm extending toward the frame and having a first end;

a second arm affixed to the frame and extending from the frame toward the first arm, the second arm including a second end spaced apart from the first end of the first arm;

a third arm extending downward from the support beam to the frame, the third arm being movably connected to the beam and to the frame for movement in directions transverse to the length of the frame; and link means bridging the space between and movably connecting the ends of the first and second arms together with the crane in a normal operating condition for movement of the frame and first leg member relative to each other in directions parallel to the length of the frame.

7. The combination according to claim 6 wherein:

the first and second ends of said arms respectively have first and second openings;

the link means has first and second ends respectively having first and second openings respectively in axial alignment with the first and second openings in the ends of the arms; and the link means includes first and second pins respectively extending through the aligned first openings in the link mean and first arm and through the aligned second openings in the link means and second arm whereby the frame and first leg member are pivotally movable relative to each other.

8. In a crane including a frame having an elongated length, and at least one pair of legs having first and second facing leg members on opposite sides of and supporting the frame and extending from the frame downward and away from each other and away from the frame in a direction transverse to the length of the frame, the combination comprising:

a first arm affixed to the first leg member and extending toward the frame;

a second arm affixed to the frame and extending from the frame toward the first arm;

a support beam mounted on the top of the frame and including an opening with an axis in the direction of the length of the frame;

the frame has an arm attachment portion including an opening with an axis in the direction of the length of the frame;

a third arm extending downward from the support beam to the frame and including an upper end having an opening in axial alignment with the opening in the support beam and a lower end having an opening in axial alignment with the opening in the arm attachment portion of the frame;

first and second arm attachment pins respectively extending through the aligned openings in the support beam and upper end of the third arm and through the aligned openings in the frame attachment portion and the lower end of the third arm whereby the support beam is pivotally movable relative to the frame in directions transverse to the length of the frame;

link means movably connecting the first and second arms together with the crane in a normal operating condition for movement of the frame and first leg member relative to each other in directions both parallel and transverse to the length of the frame; and the first leg member is pivotally connected to the support beam about an axis in the direction of the length of the frame whereby, due to the pivotal connection of the support beam to the frame, the pivotal connection of the first leg member to the support beam, and the transverse movement connection of the first leg member through the link means to the frame, the first leg member is movable in directions transverse to the length of the frame.

* * * * *